US006206245B1

(12) United States Patent
Bonningue

(10) Patent No.: US 6,206,245 B1
(45) Date of Patent: Mar. 27, 2001

(54) PUMP WITH A DELIVERY VALVE INCLUDING A BALL

(75) Inventor: Philippe Bonningue, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/353,091

(22) Filed: Jul. 15, 1999

(30) Foreign Application Priority Data

Jul. 24, 1998 (FR) ..... 98 09481

(51) Int. Cl.[7] ..... B65D 88/54
(52) U.S. Cl. ..... 222/321.7; 222/153.13
(58) Field of Search ..... 222/153.13, 384, 222/385, 321.1, 321.7, 321.9, 478

(56) References Cited

U.S. PATENT DOCUMENTS

| | | | | |
|---|---|---|---|---|
| 3,146,920 | | 9/1964 | Benjamin . | |
| 3,759,426 | | 9/1973 | Kane et al. . | |
| 4,369,899 | * | 1/1983 | Magers et al. | 222/153.13 |
| 4,375,266 | * | 3/1983 | Magers | 222/153.13 |
| 4,524,888 | * | 6/1985 | Tada | 222/153.13 |
| 5,351,863 | | 10/1994 | Cecil et al. . | |
| 5,711,460 | | 1/1998 | Saito et al. . | |

FOREIGN PATENT DOCUMENTS

| | | |
|---|---|---|
| 0 779 106 A2 | 6/1997 | (EP) . |
| 1.236.720 | 6/1960 | (FR) . |
| 1158058 | 7/1969 | (GB) . |
| 2 141 186 | 12/1984 | (GB) . |
| 6 016 6769 | 8/1985 | (JP) . |

* cited by examiner

*Primary Examiner*—Philippe Derakshani
*Assistant Examiner*—Thach H. Bui
(74) *Attorney, Agent, or Firm*—Oliff & Berridge, PLC

(57) ABSTRACT

A pump for mounting on a receptacle to dispense a substance contained therein, the pump comprising a pushbutton that is movable relative to a pump body between a low position and a high position, and co-operating therewith to define a pump chamber of variable volume, which chamber communicates with a dispenser orifice via a delivery valve including a ball that forms a retaining valve member in a housing of the pushbutton. The pushbutton includes retaining means for the ball that are integrally formed with said housing by molding plastics material.

13 Claims, 5 Drawing Sheets

PUMP WITH A DELIVERY VALVE INCLUDING A BALL

The present invention relates to a pump for mounting on a receptacle to dispense a substance contained therein.

BACKGROUND OF THE INVENTION

U.S. Pat. No. 4,355,962 discloses a pump that includes a pushbutton which is movable relative to a pump body between a low position and a high position and which co-operates therewith to define a pump chamber of variable volume, which chamber communicates with a dispensing orifice via a delivery valve which includes a ball that constitutes a retaining valve member in a housing of the pushbutton.

Such a pump comprises a relatively large number of parts and manufacture thereof is expensive.

There exists a need to have a pump whose manufacturing cost is lower, but without the reduction in cost being made to the detriment of reliability.

OBJECTS AND SUMMARY OF THE INVENTION

The invention seeks to satisfy this need.

The invention achieves this by the fact that the pushbutton includes retaining means for the ball that are integrally formed with said housing by molding plastics material.

By means of the invention, the number of component parts of the pump is reduced, thereby enabling its cost to be decreased.

In a particular embodiment, said housing is situated in a duct and said retaining means are constituted by the bottom end of said duct, which bottom end is shaped to enable the ball to be put into place in said housing by elastic deformation.

Still in a particular embodiment, the pump includes a suction valve comprising a ball forming a valve member, and the bottom end of said duct is organized so as to keep the ball of the suction valve in its closed position when the pushbutton is in its low position.

In this way, a pump is provided which is sealed while in its transport position, and that is not always true of known pumps.

Still in a particular embodiment, the pump body includes a vent suitable for communicating via a passage with the outside of the receptacle when the pushbutton is in an intermediate position between its high position and its low position, thereby enabling air to enter into the receptacle while the substance is being sucked into the pump chamber, and the pushbutton is shaped to isolate the vent from the outside when it is in its high position or its low position.

This guarantees good conditions for conserving the substance contained in the receptacle.

The inside of the receptacle does not communicate with the outside except when the pushbutton is an intermediate position between its high position and its low position, i.e. at the time that it is in use.

The substance contained in the receptacle thus remains sheltered from outside air so long as the pushbutton is in its low position for transport or in its high position waiting to be used.

For example, this ensures that solvents or perfumes contained in the substance inside the receptacle do not escape from the receptacle via the air intake passage in the event of the pump being left unused for a long period of time.

In a particular embodiment, the pushbutton has an inner skirt integrally formed therewith and suitable for sliding in sealed manner inside the pump body.

Still in a particular embodiment, said inner skirt bears in sealed manner against the pump body via its bottom portion, and the distance between the vent and said bottom portion when the pushbutton is in its low position is less than or equal to, and preferably substantially equal to, the displacement stroke of the pushbutton from its low position towards its high position, such that said bottom portion isolates said vent from the outside when the pushbutton is in its high position.

Advantageously, said inner skirt bears in sealed manner via its top portion against the top end of the pump body when the pushbutton is in its low position.

In a particular embodiment, the inner skirt has a setback between its bottom portion and its top portion, which setback provides an annular space inside the pump body, into which space said vent opens out while the pushbutton is in its low position and while it is in an intermediate position between its high position and its low position.

In a particular embodiment, the pump body connects via its top end via an annular bearing surface to a mounting skirt which is secured to the neck of the receptacle.

Advantageously, the mounting skirt is extended upwards by a cylindrical wall defining a guide for a helical spring operating in compression to return the pushbutton to its high position.

BRIEF DESCRIPTION OF THE DRAWINGS

Other characteristics and advantages of the present invention will appear on reading the following detailed description of a non-limiting embodiment thereof, and on examining the accompanying drawings, in which.

MORE DETAILED DESCRIPTION

Figure 1:
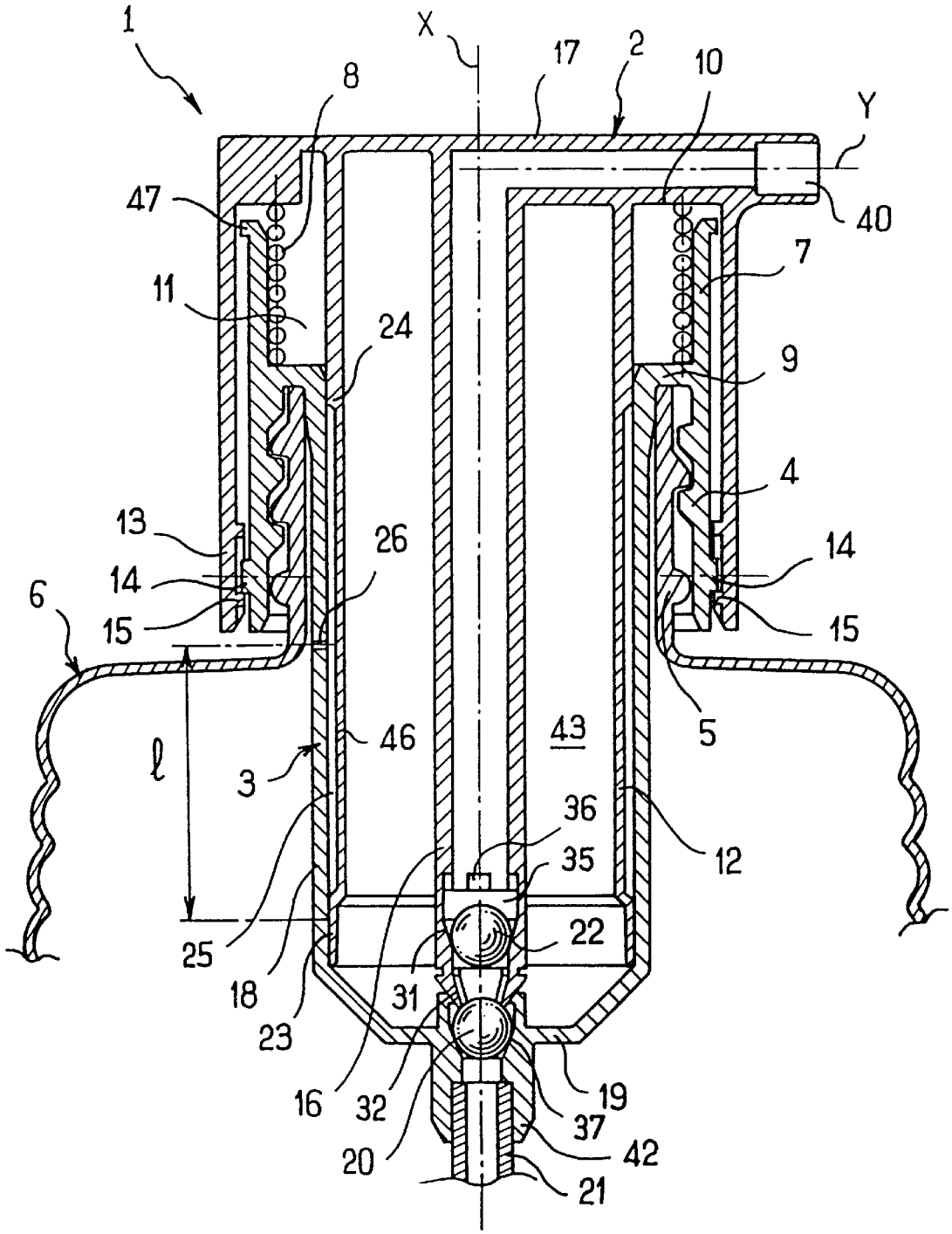
FIG. 1 is a diagrammatic axial section view of a pump constituting an embodiment of the invention.
Figure 2:
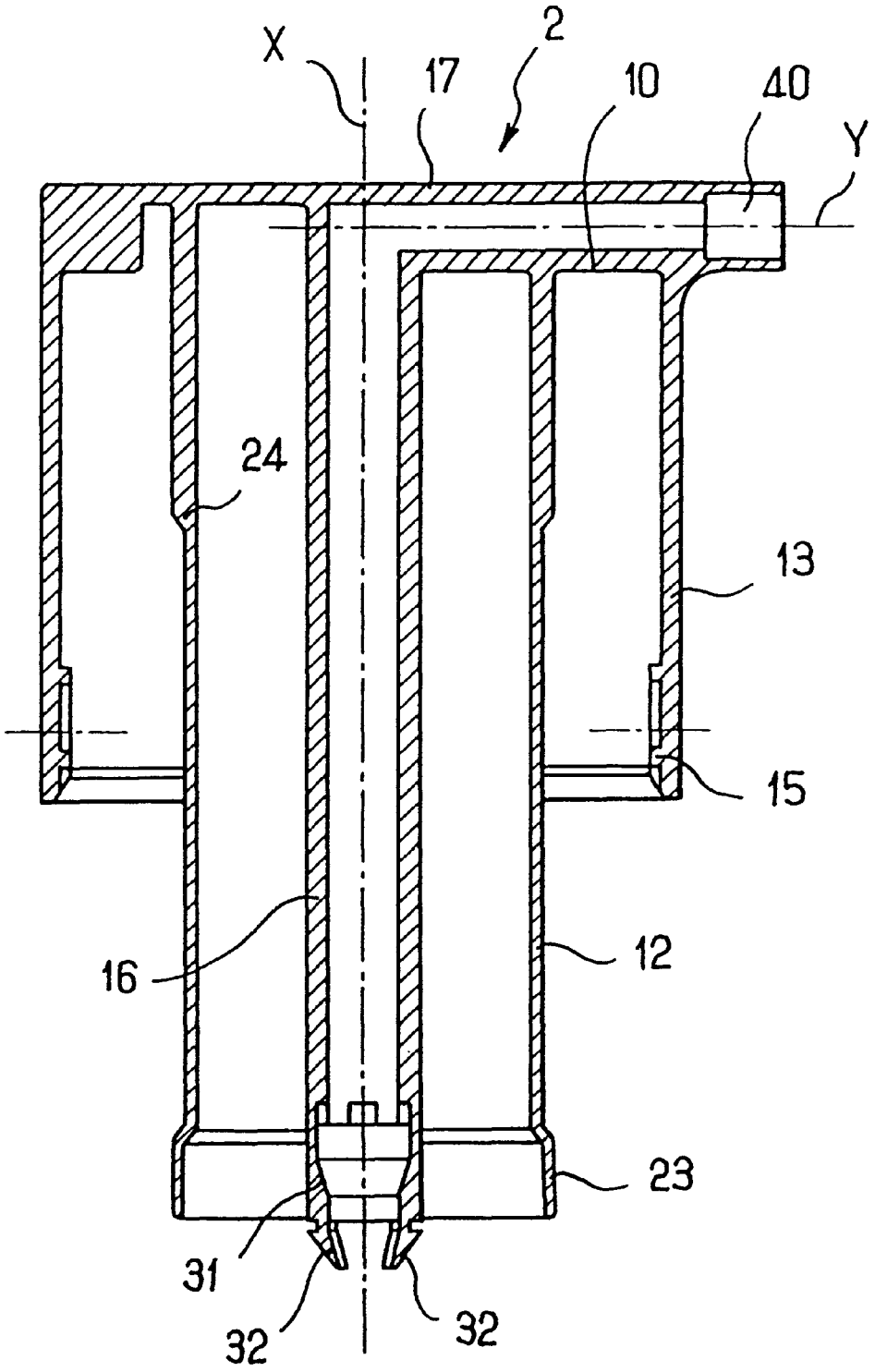
FIG. 2 shows, in isolation, the pushbutton of the pump shown in FIG. 1.

The pump 1 shown in FIG. 1 has a moving pushbutton 2 capable of moving vertically along an axis X relative to a fixed portion 3, which fixed portion has a mounting skirt 4 secured to the neck 5 of a conventional receptacle 6 that is shown in part only.

In the embodiment described, the mounting skirt 4 is screwed onto the neck 5, but in a variant it could be fixed thereto in some other manner, e.g. by snap-fastening.

The mounting skirt 4 is extended upwards by a cylindrical wall defining a guide 7 both for the pushbutton 2 and for a helical spring 8 about the axis X and operating in compression.

At its top end, the guide 7 has an annular rim 47 which limits the upward displacement stroke of the pushbutton 2.

At its bottom end, the spring 8 rests against an annular bearing surface 9 on the fixed portion 3.

This bearing surface 9 extends radially inwards from the region where the mounting skirt 4 and the guide 7 meet.

The top end of the spring 8 bears against the end wall 10 of an annular groove 11 in the pushbutton 2.

This groove 11 is formed between an inner skirt 12 that is circularly symmetrical about the axis X, and an outer skirt 13 that is coaxial therewith.

Locking means are provided on the facing faces of the outer skirt 13 and of the mounting skirt 4 to enable the pushbutton 2 to be locked in its low position as shown in FIG. 1.

This locking is used while the receptacle 6 is being transported, e.g. to ensure that there is no accidental leakage of the substance.

In the embodiment described, the above-mentioned locking means comprise studs 14 formed on the radially outer surface of the mounting skirt 4 and portions in relief 15 situated on the radially inner surface of the outer skirt 13.

These studs 14 and portions in relief 15 can co-operate in the manner of a bayonet type fastening.

To lock the pushbutton 2 in its low position, the user presses it down while the portions in relief 15 are angularly offset from the studs 14 so as to bring said portions down to the level of the studs, and then causes the pushbutton 2 to pivot about the axis X so as to engage the portions 15 in relief beneath the studs 14.

When the user releases the pushbutton 2, the studs 14 prevent the pushbutton from rising under drive from the spring 8.

To unlock the pushbutton 2, the user presses it down slightly and then pivots it so as to release the portions in relief 15.

Figure 6:
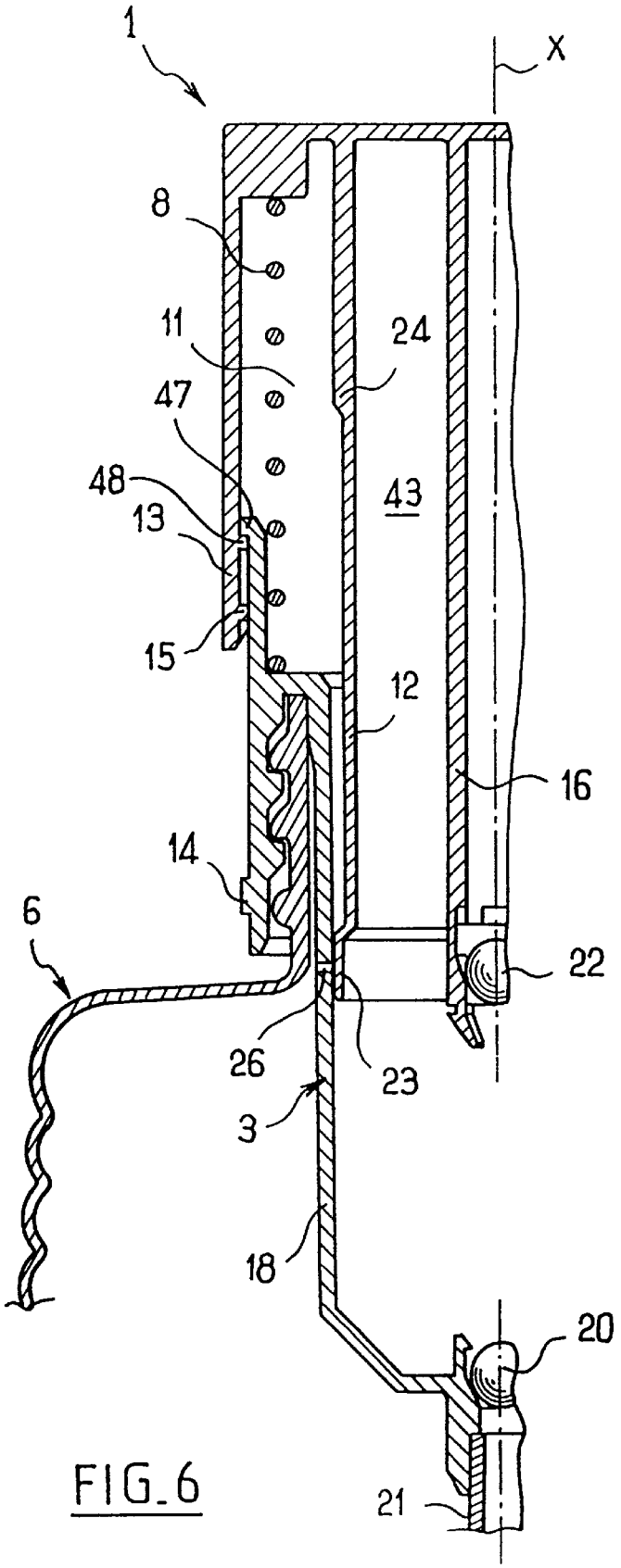

When the pushbutton 2 is in its high position, the outer skirt 13 bears via portions in relief 48 formed above the above-mentioned portions in relief 15, against the annular rim 47 of the guide 7, as can be seen in FIG. 6.

A central duct 16 is integrally formed with the inner skirt 12 by molding a plastics material.

The duct 16 is centered on the axis X and its top end is connected to a lateral duct 17, likewise integrally formed with the remainder of the pushbutton 2 by molding a plastics material.

The lateral duct 17 opens to the outside of the pushbutton 2 via an outlet orifice 40 which points in a direction Y that is perpendicular to the axis X.

The above-mentioned annular bearing surface 9 is connected to the top end of a tubular pump body 18 which is closed at its bottom end by an end wall 19.

The end wall 19 constitutes a seat for a ball 20 and it has an endpiece 42 for connection to a dip tube 21 that extends to the bottom of the receptacle 6 where the tube opens out.

The ball 20 together with its seat formed on the end wall 19 constitutes a suction valve as described below.

Figure 4:
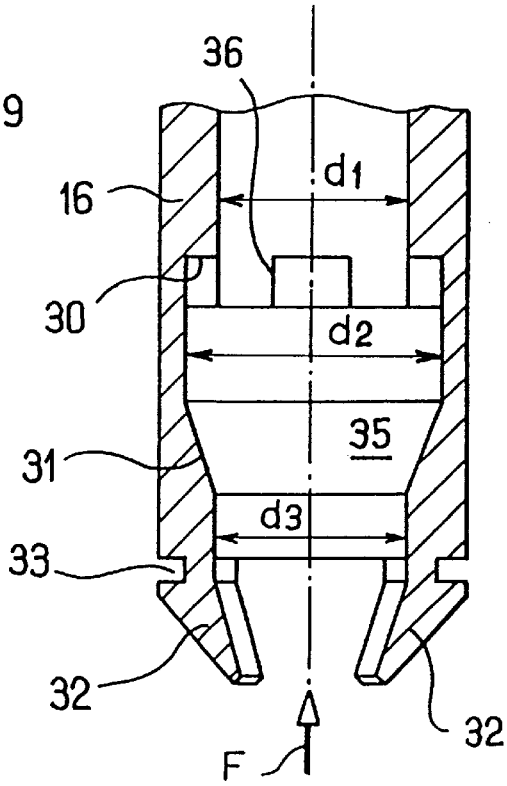
FIG. 4 shows a detail of the pushbutton.

As can be seen in FIG. 4, the bottom end of the central duct 16 defines a housing 35 in which a ball 22 is retained.

The ball 22 together with its seat made inside the housing 35 constitutes a delivery valve, as described below.

The bottom portion 23 of the inner skirt 12 is shaped to slide in sealed manner in contact with a circularly cylindrical portion of the inside surface of the pump body 18.

The top portion 24 of the inner skirt 12 is shaped to press in sealed manner against the top end of the pump body 18 when the pushbutton 2 is in its low position, as shown in FIG. 1.

More precisely, the top portion 24 is shaped to be inserted at a friction fit in the pump body 18 when the pushbutton 2 is in its low position.

The inner skirt 12 has an annular setback 46 between its bottom portion 23 and its top portion 24.

This setback 46 co-operates with the pump body 18 to define an annular space 25 whose function is explained below.

A vent 26 opening out at the base of the neck 5 is made in the pump body 18 to put the above-mentioned annular space 25 into communication with the inside of the receptacle.

The pump body 18 presses in sealed manner at its top end against the inside surface of the neck 5.

The bottom end of the central duct 16 housing the ball 22 is described in greater detail below with reference to FIG. 4.

The duct 16 has an inside shoulder at 30, and on going past said shoulder in a downward direction inside the housing 35, the diameter of the duct passes from a value $d_1$ that is smaller than the diameter of the ball 22 to a diameter $d_2$ which is slightly greater than the diameter of the ball.

The inside diameter of the duct 16 then tapers progressively downwards over a conical surface 31 until it reaches a value $d_3$ that is slightly smaller than the diameter of the ball 22.

The conical surface 31 serves as a seat for the ball 22 and the cylindrical surface of diameter $d_2$ extends above said surface 31 around the axis X to a height which is sufficient to enable the ball 22 to move away from its seat 31 while substance is being dispensed in such a manner as to enable the desired flow rate to be obtained.

At its bottom end, the central duct 16 terminates in tabs 32 which are directed radially inwards and shaped in such a manner as to be capable of deforming radially outwards while the ball 22 is being inserted from the bottom into the housing 35 along arrow F.

Recesses 33 are formed in the outsides of the tabs 32 where the join the remainder of the duct 16 so as to impart the flexibility required for enabling the ball 22 to be installed.

Portions in relief 36 are formed at the top portion of the housing 35 to prevent the ball 22 from closing the central duct 16 while the substance is being dispensed.

Figure 3:
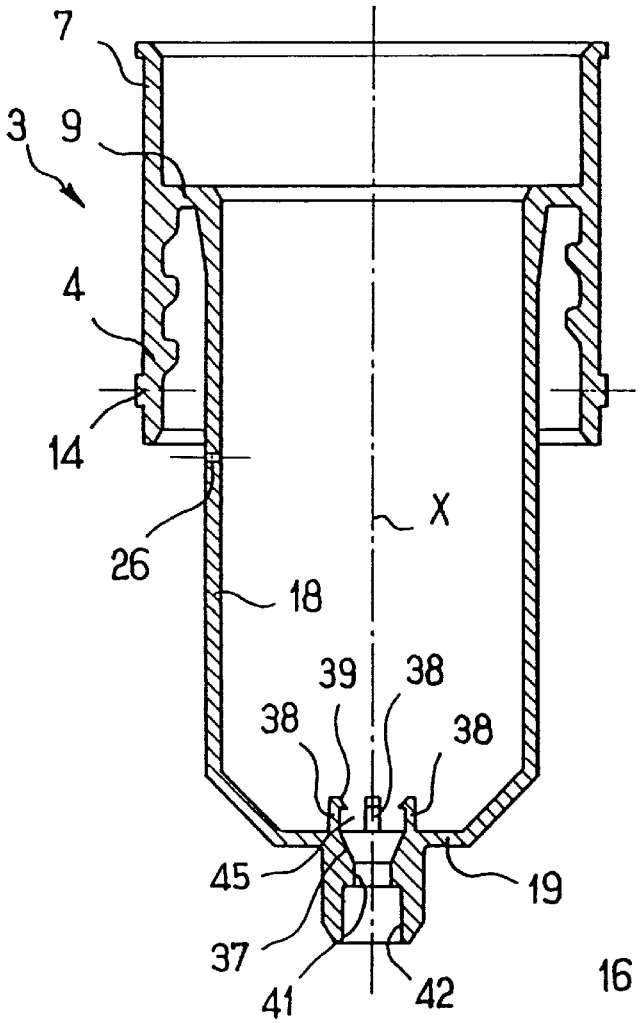
FIG. 3, shows, on its own, the fixed portion of the pump shown in FIG. 1.

FIG. 3 shows the fixed portion 3 of the pump in isolation.

As can be seen in FIG. 3, the end wall 19 has a conical recess 37 centered on the axis X and converging downwards, for the purpose of serving as a seat for the ball 20.

Tabs 38 extend said recess 37 upwards so as to constitute a cage 45 in which the ball 20 is retained, while leaving it free to lift off the seat 37 while substance is being taken from the receptacle.

In the example described, there are four such tabs 38 and each has a tooth 39 projecting radially inwards.

The teeth 39 are chamfered so as to facilitate inserting the ball 20 downwards into the cage 45.

The tabs 38 deform radially outwards in elastic manner so as to enable the ball 20 to move past the teeth 39 while the ball is being put into place in the cage 45.

The end of the recess 37 communicates via a hole 41 with the inside of the endpiece 42 in which the dip tube 21 is engaged as a force-fit, as shown in FIG. 1.

It will be observed that when the pushbutton 2 is in its low position as shown in FIG. 1, the tabs 32 of the central duct 16 come into contact with the ball 20 and are subjected to a small amount of elastic deformation, thereby holding the ball 20 against its seat 37.

The endpiece 42 is thus closed and substance is prevented from rising into the pump, thereby reducing the risk of any accidental leakage of substance while the receptacle is being transported.

The annular space defined by the pump body 18 and the inner skirt 12 around the central duct 16 constitutes a pump chamber 43 whose volume varies as the pushbutton 2 moves axially along the axis X.

The pump 1 operates as follows.

Figure 5:
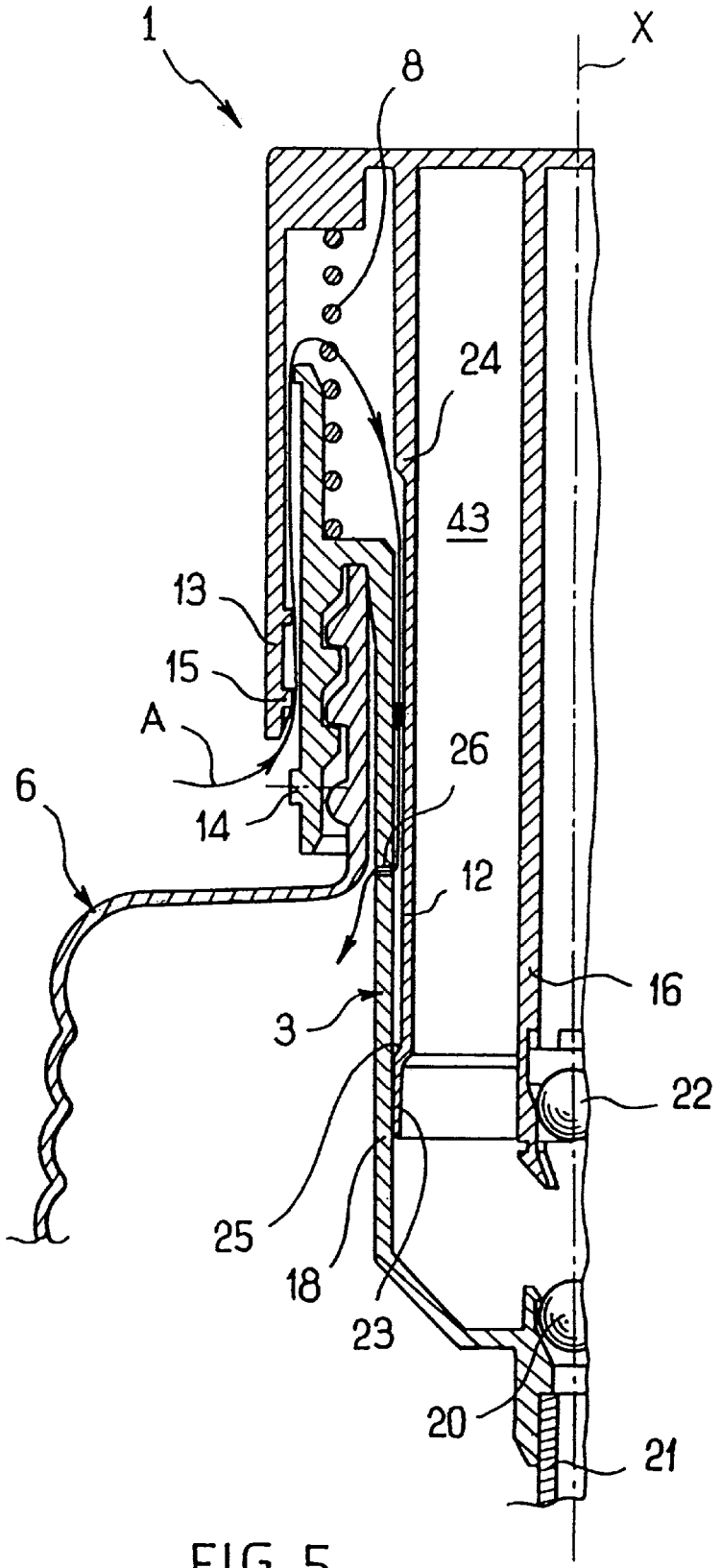
FIGS. 5 and 6 show the pushbutton in an intermediate position and in its high position, respectively.

Once the pushbutton 2 has been unlocked as explained above, it rises under the return force of the spring 8 until it takes up the high position as shown in FIG. 6, after passing through the intermediate position as shown in FIG. 5.

During the upward movement of the pushbutton 2, the volume of the pump chamber 43 increases, thereby establishing suction therein, lifting the ball 20 of the suction valve, and sucking substance from the bottom of the receptacle 6 along the dip tube 21.

The ball 22 of the delivery valve is then pressed against its seat 31 and isolates the central duct 16.

The taking of substance from the receptacle 6 causes the pressure therein to drop.

In the embodiment described, air is allowed to enter into the receptacle 6 during the upward movement of the pushbutton 2 because the vent 26 is in communication with the outside of the receptacle via the annular space 25.

In FIG. 5, arrow A shows the path followed by the air entering the receptacle 6 while the pushbutton 2 rises.

The air passes initially between the mounting skirt 4 and the outer skirt 13 of the pushbutton 2, and then reaches the vent 26 by passing along the annular space 25.

It will be observed that ingress of air into the receptacle 6 is made possible by the fact that the top portion 24 of the inner skirt 12 has ceased to press in sealed manner against the pump body 18.

When the pushbutton 2 reaches its high position as shown in FIG. 6, the bottom portion 23 of the inner skirt 12 takes up a position in register with the vent 26 so as to close it.

To this end, the up stroke of the pushbutton is substantially equal to the distance 1 between the vent 26 and the bottom portion 23 of the inner skirt 12 when the pushbutton is in its low position.

As a result, the inside of the receptacle 6 again ceases to communicate with the outside so as to ensure that the substance contained in the receptacle 6 is properly conserved.

In other words, the pushbutton 2 can be left in its high position without any fear of the substance being degraded by outside air because the passage via which the vent 26 communicates with the outside is closed by the bottom portion 23 of the inner skirt 12.

When the user pushes down the pushbutton 2, the volume of the pump chamber 23 decreases, thereby compressing the substance that is to be found therein.

The ball 20 of the suction valve is then pressed against its seat 37, preventing any return of the substance into the receptacle 6, while the ball 22 of the delivery valve is lifted by the pressure of the substance, thereby enabling it to flow via the central duct 16 and then via the lateral duct 17 so as to reach the dispensing orifice 40.

By means of the invention, a pump is provided that has few component elements, and specifically in the example described: a pushbutton 2 and a fixed portion 3 each constituted (with the exception of the two balls and the spring) as a single molded piece respectively of polyethylene and of polypropylene in particular, which are of low cost to manufacture and reliable in operation.

The risk of the substance leaking while the receptacle is being transported is reduced by the ball of the suction valve being locked in place.

Finally, the pump enables the substance to be conserved while being protected from outside air even when the pushbutton is left for a long period of time in its high position.

Naturally, the invention is not limited by the embodiment described above.

In particular, various modifications can be made to the pump, for example concerning the manner in which the fixed portion 3 is fixed to the receptacle 6.

Naturally, the invention is not limited to a pump having air intake as described above, but is equally applicable to a pump that does not have air intake, with the substance for dispensing then being contained, for example, in a deformable bag that is capable of shrinking as the quantity of substance it contains diminishes.

When the pump does not have air intake, the vent 26 is unnecessary, as is the setback 46.

What is claimed is:

1. A pump for mounting on a receptacle to dispense a substance contained therein, the pump comprising:

a pushbutton that is movable relative to a pump body between a low position and a high position, and co-operating therewith to define a pump chamber of variable volume, the pump chamber communicating with a dispenser orifice via a delivery valve including a ball that forms a valve member, the ball being retained in a housing of the pushbutton, wherein the pushbutton includes retaining means for the ball that is integrally formed with the housing by molded plastic material, the housing is in a duct having a bottom end and the retaining means are constituted by the bottom end of the duct, the bottom end shaped such that the ball is put into place in the housing by elastic deformation, the pump includes a suction valve comprising a second ball forming a second valve member, and the bottom end keeps the ball of the suction valve in its closed position when the pushbutton is in its low position.

2. A pump for mounting on a receptacle to dispense a substance contained therein, the pump comprising:

a pushbutton that is movable relative to a pump body between a low position and a high position, and co-operating therewith to define a pump chamber of variable volume, the pump chamber communicating with a dispenser orifice via a delivery valve including a ball that forms a valve member, the ball being retained in a housing of the pushbutton, wherein the pushbutton includes retaining means for the ball that is integrally formed with the housing by molded plastic material, the pump body including a vent suitable for communicating via a passage with the outside of the receptacle when the pushbutton is in an intermediate position between the high position and the low position, thereby enabling air to enter into the receptacle while the substance is being sucked into the pump chamber, and the pushbutton is shaped to isolate the vent from the outside when in the high position or the low position.

3. A pump according to claim 2, wherein the pushbutton has an inner skirt integrally formed therewith and suitable for sliding in sealed manner inside the pump body.

4. A pump according to claim 3, wherein the inner skirt bears in sealed manner against the pump body via its bottom portion, and wherein the distance between the vent and the bottom portion when the pushbutton is in its low position is less than or equal to, the displacement stroke of the pushbutton from its low position towards its high position, such that the bottom portion isolates the vent from the outside when the pushbutton is in its high position.

5. A pump according to claim 3, wherein the inner skirt bears in sealed manner via its top portion against the top end of the pump body when the pushbutton is in its low position.

6. A pump according to claim 4, wherein the inner skirt bears in sealed manner via its top portion against the top end of the pump body when the pushbutton is in its low position, wherein the inner skirt has a setback between its bottom portion and its top portion, which setback provides an annular space inside the pump body, into which space said vent opens out while the pushbutton is in its low position and while it is in an intermediate position between its high position and its low position.

7. A pump for mounting on a receptacle to dispense a substance contained therein, the pump comprising:

a pushbutton that is movable relative to a pump body between a low position and high position, and co-operating therewith to define a pump chamber of variable volume, the pump chamber communicating with a dispenser orifice via a delivery valve including a ball that forms a valve member, the ball being retained in a housing of the pushbutton, wherein the pushbutton includes retaining means for the ball that is integrally formed with the housing by molded plastic material, the pump has an annular bearing surface and the pump body has a top end, the pump body connecting at the top end via the annular bearing surface to a mounting skirt which is secured to a neck of the receptacle.

8. A pump according to claim 7, wherein the mounting skirt is extended upwards by a cylindrical wall defining a guide for a helical spring operating in compression to return the pushbutton to its high position.

9. A pump according to claim 3, wherein the inner skirt bears in sealed manner against the pump body via its bottom portion, and wherein the distance between the vent and the bottom portion when the pushbutton is in the low position is substantially equal to the displacement stroke of the pushbutton from the low position towards the high position, such that the bottom portion isolates the vent from the outside when the pushbutton is in the high position.

10. A pump for mounting on a receptacle to dispense a substance contained therein, the pump comprising:

a pushbutton that is movable relative to a pump body between a low position and a high position, and co-operating therewith to define a pump chamber of variable volume, the pump chamber communicating with a dispenser orifice via a delivery valve including a ball that forms a valve member, the ball being retained in a housing of the pushbutton, wherein the pushbutton includes retaining means for the ball, the housing is situated in a duct having a bottom end and the retaining means are constituted by the bottom end of the duct, the bottom end being shaped so the ball is put into place in the housing by elastic deformation, the pump includes a suction valve comprising a second ball forming a second valve member, and the bottom end keeps the ball of the suction valve in a closed position when the pushbutton is in the low position.

11. A pump for mounting on a receptacle to dispense a substance contained therein, the pump comprising:

a pushbutton that is movable relative to a pump body between a low position and a high position, and co-operating therewith to define a pump chamber of variable volume, the pump chamber communicating with a dispenser orifice via a delivery valve including a ball that forms a valve member, the ball being retained in a housing of the pushbutton, wherein the pushbutton includes retaining means for the ball that are integrally formed with the housing by molded plastic material, the housing is situated in a duct having a bottom end and the retaining means are constituted by the bottom end of the duct, the pump includes a suction valve comprising a second ball forming a second valve member, the bottom end keeps the ball of the suction valve in a closed position when the pushbutton is in the low position.

12. A pump for mounting on a receptacle to dispense a substance contained therein, the pump comprising:

a pushbutton that is movable relative to a pump body between a low position and a high position, and co-operating therewith to define a pump chamber of variable volume, the pump chamber communicating with a dispenser orifice via a delivery valve including a ball that forms a valve member, the ball being retained in a housing of the pushbutton, wherein the pushbutton includes retaining means for the ball, the housing is situated in a duct having a bottom end and the retaining means are constituted by the bottom end of the duct, the pump includes a suction valve comprising a second ball forming a second valve member, and the bottom end keeps the ball of the suction valve in a closed position when the pushbutton is in the low position.

13. A pump for mounting on a receptacle to dispense a substance contained therein, the pump comprising:

a pushbutton that is movable relative to a pump body between a low position and a high position, and the pushbutton and the pump body define a pump chamber of variable volume, the pump chamber communicating with a dispenser orifice via delivery valve including a ball that forms a valve member, the ball being retained in a housing of the pushbutton, wherein the pushbutton includes retaining means for the ball that are integrally formed with the housing by molded plastic material, the housing is situated in a duct having a bottom end, the pump includes a suction valve comprising a second ball forming a second valve member, and the bottom end keeps the ball of the suction valve in a closed position when the pushbutton is in the low position.

* * * * *